United States Patent [19]

Gerry

[11] 4,413,304

[45] Nov. 1, 1983

[54] ELECTROMAGNETIC FIELD COMPENSATED CABLE

[76] Inventor: Martin E. Gerry, 13452 Winthrope St., Santa Ana, Calif. 92705

[21] Appl. No.: 380,476

[22] Filed: May 20, 1982

Related U.S. Application Data

[63] Continuation-in-part of Ser. No. 345,939, Feb. 3, 1982, and Ser. No. 282,755, Jul. 13, 1981.

[51] Int. Cl.[3] ..... F23Q 3/00; H01Q 1/52

[52] U.S. Cl. ..... 361/253; 343/851

[58] Field of Search ..... 307/89; 361/253, 254; 343/851

[56] References Cited

U.S. PATENT DOCUMENTS 2,585,907 2/1952 Barret ..... 343/851 X 3,060,428 10/1962 Dolan ..... 343/851

*Primary Examiner*—Donald A. Griffin

[57] ABSTRACT

An electromagnetic field compensated cable having an electrically insulating casing (20, 40, 50) includes a structure (21–22, 41, 51) that effects cancellation of electric and/or magnetic field components due to current flow through the cable. One configuration includes a central twisted pair of insulated leads (21, 22) wherein only one end of each of the leads (23, 24) is terminated in a connector (25, 26). Another configuration has a central structure of conductive wire of alternating rectangular shape. (41, 51).

13 Claims, 5 Drawing Figures

ELECTROMAGNETIC FIELD COMPENSATED CABLE

CROSS REFERENCE TO RELATED PATENT APPLICATIONS

This application is a continuation-in-part of copending application Ser. No. 345,939 filed Feb. 3, 1982 and application Ser. No. 282,755 filed July 13, 1981, incorporated by reference herein.

DESCRIPTION

1. Technical Field

This invention is in the field of high voltage distribution cables, and in particular such high voltage cables as are utilized in engine ignition systems.

2. Background Art

Prior art engine ignition cables of the high voltage type utilize hard wire conductors embedded in an electrical insulation or utilize a carbon or other high resistance conductors.

The hard wire embedded conductor cable provides substantially no attenuation of ignition current that it supplies to the engine's electrical igniter, but produces large electromagnetic fields that cause noise to be induced in the antenna of an automotive receiver.

The carbon or other high resistance embedded conductor cable is generally of the order of 15,000 ohms DC resistance. Whereas such high resistance reduces the electromagnetic radiation, it nevertheless causes substantial reduction of ignition current in the secondary high voltage ignition transformer circuit and hence causes a substantial decrease in electrical energy delivered to the igniter.

DISCLOSURE OF INVENTION

It is an objective of this invention to provide means for conducting high transient currents between the ignition transformer secondary winding output and the igniters without any substantial quantity of electromagnetic energy coupling into the radio receiver antenna of an automotive installation.

It is another objective of this invention to reduce the circuit reactance of the combination of ignition transformer secondary winding and the high voltage cables coupling the secondary to the igniters.

It is still another objective of this invention to create a high voltage distributed capacity cable which by its own structure cancels its own generated electric and magnetic field components so as to minimize electromagnetic radiation therefrom.

Accordingly, a high voltage cable is constructed utilizing a pair of twisted or transposed turns of electrically insulated wires wherein one end of each of the wires remains unterminated, and the other ends of each wire is terminated in a connector in conventional manner. Thus, the result is distributed capacity coupling between these wires over the entire length of the cable. In its use in ignition circuits, this cable permits an increased ignition current flow due to reduced circuit reactance, since the capacitive reactance of the cable compensates for the inductive reactance of the ignition transformer secondary winding. The transposition of the pair of wires results in cancellation of magnetic field components along the cable length and cancellation of electric field components between such wire pair.

DETAILED DESCRIPTION OF BEST MODE FOR CARRYING OUT THE INVENTION

Figure 1:
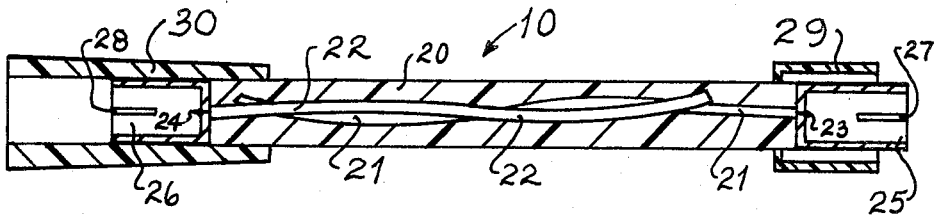
FIG. 1 is a cross-section view, partially in elevation of the ignition cable in accordance with the invention.

Referring to FIG. 1, a high voltage cable 10, for general purposes usage, but also having utilization in an ignition circuit of an automotive system, takes advantage of the principle of distributed capacity between a pair of twisted or transposed wires to provide capacitive coupling of an ignition transformer secondary winding through a high voltage distributor to connect an igniter thereto.

Cable 10 comprises a pair of twisted or transposed pair of insulated wires 21 and 22. The insulation on these wires provides the requisite dielectric material such as polytetrafluorethylene (trade name of TEFLON) between the inner conductors 23 and 24 respectively of these wires electrically terminating at connectors 25 and 26 respectively. The opposite ends of each of these wires are unterminated so that a continuous distributed capacity is realized over the length of the cable. The pitch of the transposed wires over each other is not critical but should be as tight or as close together as possible. Each of wires 21 and 22 may have center conductors of about number 20 gauge with a Teflon insulation thereover.

Connector 25 has at least one slit 27 therein and connector 26 also has at least one slit 28 therein to provide the necessary flexibility in the connectors so that this cable can be connected between one of the distributor ports and the center electrode terminal of one of the igniters. A similar cable with suitable connectors may be used to make connection between the high voltage port of the ignition transformer secondary winding and the center distributor port.

A suitable electrical insulation material 20 covers and molds therein wire pair 21-22, which material 20 is also molded to connectors 25 and 26. An electrically insulating cup 29 is generally used to hold connector 25 of this cable secure in one of the distributor ports, and a rather thick-walled and long sleeve 30 of high quality high voltage insulating material is used over a portion of the cable to hold connector 26 secure to the center electrode terminal of the igniter, also partially covering the ceramic insulator of the igniter in order to reduce voltage arcs and corona formation external to and in proximity of the igniter when extremely high voltages and currents are utilized by the ignition system in which this cable is installed.

Figure 2:
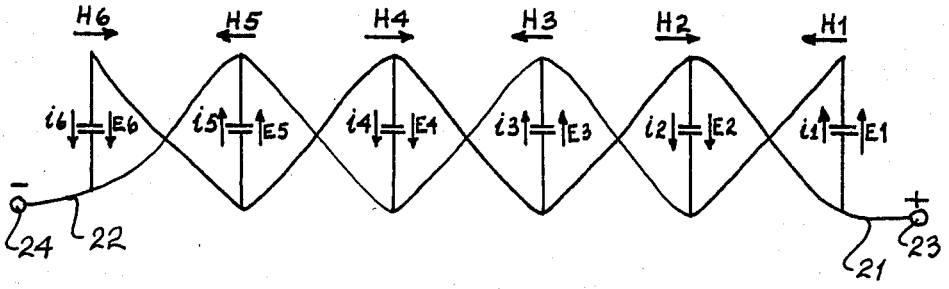
FIG. 2 is an equivalent circuit schematic of the cable of FIG. 1 for the purpose of explaining its functions.

Referring to FIG. 2, an electrical equivalent circuit of wires 21 and 22 and their respective terminations at 23 and 24 are shown having a number of transposed turns of wire as wound in FIG. 1 configuration. Each of the turns of wire are shown illustratively expanded and in particular largely expanded in their vertical dimension in the drawing so that the electromagnetic field components can be ascertained and illustrated.

Assuming at one instant of time that termination 23 of wire 21 is at a positive potential and termination 24 of wire 22 is at a negative potential with respect to the potential at 23 due to ignition current flow comprising displacement current components i1, i2, i3, i4, i5, i6 created by their respective electric field components E1, E2, E3, E4, E5, E6, it can be seen that cable 10 as structured acts as a distributed capacitor with theoretically infinite number of capacitive elements traversing the length of wires 21–22. As an example, since electric field vector E1 will be established in a direction from the positively charged wire 21 to the negatively charged wire 22, electric field vector E2 will also be established in a direction from its positively charged wire to its negatively charged wire, but due to wire transposition, vector E3 will be in a direction opposite to vector E1. Hence, currents i1 and i2 will be displaced in a direction between their positive and negative source potentials, namely wires 21 and 22 in the same direction as their electric field components. Consequently, although the electric field vectors will change in direction with every turn of wire, and thereby cancel each other, the displacement currents will pass between wires 21 and 22 in similar manner as displacement current transfers between plates of a capacitor in a manner well documented by Maxwell's equations. It is well known that ignition current is a complex transient wave which a capacitor will pass readily.

Applying the right hand rule of current and magnetic field directions, it can be seen from the diagram that magnetic field vector component H1 will be perpendicular to current component i1, and that magnetic field vector component H2 will be perpendicular to current component direction i2. Since displacement current i1 is in opposite directions to displacement current i2 the direction of vector H1 will be opposite to the direction of vector H2 and of equal magnitude, thus cancelling each other insofar as inducing a magnetic field into the antenna of the ratio receiver. In similar manner H3 will be cancelled by H4, and H5 will be cancelled by H6. It is pointed out that the magnetic fields were simply illustrated in a single plane whereas in actuality such fields are circumferential to the cable consisting of wires 21–22, with field components that cancel each other everywhere along the length of the cable.

Only two turns or wire transpositions were illustrated in FIG. 1 for largeness and clarity. In actual practice, four type 10 cables were constructed and tested for their ability to deliver increased current to the igniters, as measured by suitable instrumentation and also visibly observing the arc intensities across the igniter bases using a suitable test fixture therefor. Cables having lengths of 1.5, 2.0, 2.5 and 3.0 feet were constructed. There was little difference in ignition current magnitudes between the system utilizing any of the four cable lengths indicating that the total capacitive magnitudes may be broad over the range of frequencies encountered in an ignition transient current wave. However, the ignition current increased approximately 2.5 times over the current experienced with the usage of a hard copper wire center conductor cable.

Figure 3:
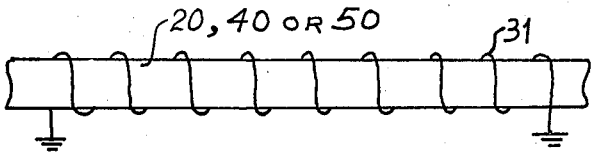
FIG. 3 is a partial elevation view of the cables of FIGS. 1, 4 and 5 showing the optional use of a ground terminated wire wound on the outer surface of the cables along their lengths.
Figure 4:
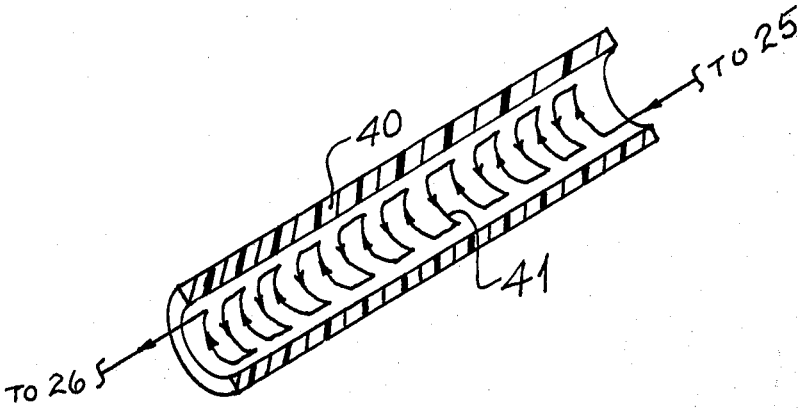
FIG. 4 is a partial cross-section view, partly in perspective, of a field compensated cable having reduced radiation characteristics.
Figure 5:
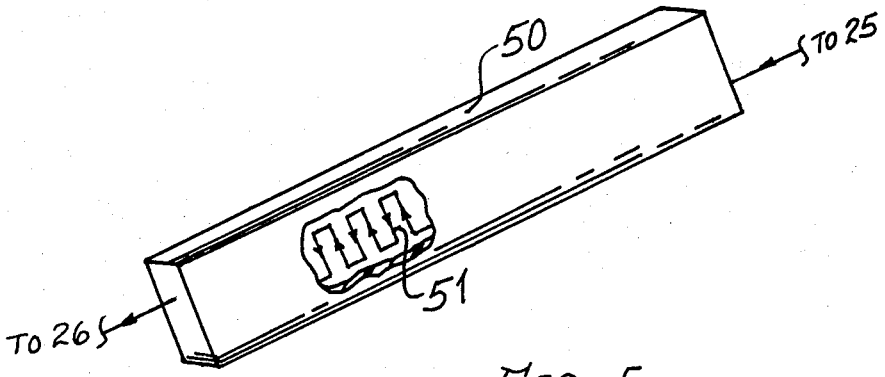
FIG. 5 is a partial perspective view, partly in cross-section, of a field compensated cable of reduced radiation characteristics, similar in function to the cable of FIG. 5.

Referring to FIG. 3, the cables of FIGS. 1, 4 and 5 may have a wire 31 wound over the outer surfaces of any of these cables, and such wire grounded either at one or both ends. This will eliminate any minute stray electromagnetic radiation caused by structural imballance of the turns in any of these cables.

Referring to FIG. 4, electrical conductor 41 is formed in generally rectangular shaped configuration and such conductor is molded within tubular insulator 40. One end of conductor 41 is electrically joined to a connector 25 similar to a like connector shown in FIG. 1, and the other end of conductor 41 is electrically joined to a connector 26 similar to a like connector illustrated by FIG. 1. If conductor 41 is electrically insulated, then the adjacent vertical portions as illustrated in the figure could abut each other, thereby minimizing the lengths of the horizontal portions of this conductor. Such closely-spaced format is desireable in that the magnetic field components in this structure of horizontal direction are additive and therefore it is desireable to maintain them as small as possible. On the other hand, the magnetic field components of adjacent vertical portions are in opposite directions in view of the current flow directions in such adjacent vertical portions, to cause cancellation of all vertical magnetic field components. Connectors as used in FIG. 1 configuration are also used for this configuration.

Referring to FIG. 4, electrical conductor 51 is formed in generally rectangular shaped configuration and such conductor is molded within insulator 50. One end of conductor 51 is electrically joined to a connector 25 similar to a like connector shown in FIG. 1, and the other end of conductor 51 is electrically joined to a connector 26 similar to a like connector illustrated by FIG. 1. If conductor 51 is electrically insulated, then the adjacent vertical portions as illustrated in the figure could abut each other, thereby minimizing the lengths of the horizontal portions of this conductor. Such closely-spaced format is desireable in that the magnetic field components in this structure of horizontal direction are additive and therefore it is desireable to maintain them as small as possible. On the other hand, the magnetic field components of adjacent vertical portions are in opposite directions in view of the current flow directions in such adjacent vertical portions, to cause cancellation of all vertical magnetic field components. Connectors as used in FIG. 1 configuration are also used for this configuration.

I claim:

1. An electromagnetic field compensated cable, comprising the combination of:

an electrically insulating casing; and means, within said casing and integral with said cable, for effecting cancellation of field components generated by current flow in said cable, said means constituting a twisted pair of electrically insulated wires, said twisted pair having first and second ends, one of said twisted pair being electrically terminated at said first end and unterminated at said second end, the other of said twisted pair being electrically terminated at said second end and unterminated at said first end.

2. The cable as stated in claim 1, wherein said means constitutes an electrical conductor having a shape resembling a rectangular waveform.

3. The cable as stated in claim 2, including a grounded coil of wire wound over the insulating casing.

4. The cable as stated in claim 1, wherein said means effects cancellation of magnetic and electric field components.

5. The cable as stated in claim 1, including electrical connectors effecting the electrical terminations.

6. The cable as stated in claim 1, including a grounded coil of wire wound over the insulating casing.

7. The cable as stated in claim 1, wherein said twisted pair constitutes a distributed capacity structure substantially along the entire length of the cable.

8. An electromagnetic field compensated cable, comprising the combination of:

an electrically insulating casing; and means, within said casing and integral with said cable, for effecting cancellation of field components generated by current flow in said cable, said means constituting a transposed pair of electrically insulated wires, said transposed pair having first and second ends, one of said transposed pair being electrically terminated at said first end and unterminated at said second end, the other of said transposed pair being electrically terminated at said second end and unterminated at said first end.

9. The cable as stated in claim 8, wherein said means effects cancellation of magnetic and electric field components.

10. The cable as stated in claim 8, including electrical connectors effecting the electrical terminations.

11. The cable as stated in claim 8, including a grounded coil of wire would over the insulating casing.

12. The cable as stated in claim 8, wherein said transposed pair constitutes a distributed capacity structure substantially along the entire length of the cable.

13. The cable as stated in claim 8, wherein said means constitutes an electrical conductor having a shape resembling a rectangular waveform.

* * * * *